US005791573A

United States Patent [19]

Okuya

[11] Patent Number: 5,791,573

[45] Date of Patent: Aug. 11, 1998

[54] CRUSHING-BREAKING APPARATUS

[76] Inventor: Yasuaki Okuya, 52, Soramachi, Heisaka-Cho, Nishio-City, Aichi-Pref, Japan

[21] Appl. No.: 791,902

[22] Filed: Jan. 31, 1997

Related U.S. Application Data

[63] Continuation-in-part of Ser. No. 351,518, Dec. 7, 1994, abandoned.

[51] Int. Cl.[6] ..... B02C 1/10

[52] U.S. Cl. ..... 241/264

[58] Field of Search ..... 241/264–269, 241/291

[56] References Cited

U.S. PATENT DOCUMENTS

| | | |
|---|---|---|
| 3,156,421 | 11/1964 | Lutz . |
| 4,768,723 | 9/1988 | Fritz . |
| 5,462,237 | 10/1995 | Wellmann . |

FOREIGN PATENT DOCUMENTS

| | | |
|---|---|---|
| 2 409 474 | 6/1979 | France . |
| 251533 | 5/1911 | Germany . |
| 1 085 401 | 7/1960 | Germany . |
| 2621043 | 12/1976 | Germany . |
| 27-9879 | 11/1927 | Japan . |
| 55-16801 | 6/1952 | Japan . |
| 54-3953 | 1/1979 | Japan . |
| 54-39261 | 3/1979 | Japan . |
| 60-33542 | 4/1985 | Japan . |
| 62-279849 | 2/1987 | Japan . |
| 62-95736 | 6/1987 | Japan . |
| 5 184959 | 7/1993 | Japan . |
| 6 508061 | 12/1993 | Japan . |
| 6-106083 | 4/1994 | Japan . |
| 6-182238 | 7/1994 | Japan . |
| 656325 | 6/1986 | Switzerland . |
| WO8503887 | 9/1985 | WIPO . |
| WO9221441 | 12/1992 | WIPO . |

*Primary Examiner*—Mark Rosenbaum
*Attorney, Agent, or Firm*—Cushman Darby & Cushman IP Group of Pillsbury Madison & Sutro LLP

[57] ABSTRACT

A crushing-breaking apparatus includes a frame, a fixed cutlery device and a rocking cutlery device. Both cutlery devices have many cutleries which are disposed at locations offset relative to the cutleries of the other cutlery device. And the rocking cutlery device is rocked pivotally around the lower pivot by an oil pressure cylinder as the fulcrum of its pivot. Useless casting products are crushed and broken by both cutlery devices.

10 Claims, 12 Drawing Sheets

CRUSHING-BREAKING APPARATUS

This is a Continuation-in-Part (MPEP 201.09) of 4(a) National application Ser. No. 08/351,518 filed Dec. 7, 1994, now abandoned.

BACKGROUND OF THE INVENTION

1. Technical Field of the Invention

The present invention relates generally to a crushing-breaking apparatus, and more particularly to a crushing-breaking apparatus for useless casting products such as weirs, runners and so on.

2. Prior Art

A crushing-breaking apparatus includes a fixed cutlery device with horizontal line shaped cutleries to engaged with said cutleries of the fixed cutlery device. Due to such the linear motion of said linear motion cutlery device and said horizontal line shaped cutleries, surplus forces loaded by large irregular products affect badly an oil pressure cylinder, both cutlery devices and a frame. Then such products are not only crushed/broken, but also the oil pressure cylinder, both cutlery devices and a frame are easily transformed.

SUMMARY OF THE INVENTION

It is therefore an object of the invention to provide an improved crushing-breaking apparatus which obviates the above conventional drawbacks.

In accordance with characteristic of the present invention, a crushing-breaking apparatus comprises:

a frame having side plates facing each other and spaced apart by predetermined distance, a fixed cutlery device provided in the frame, having a plurality of first projection-shaped cutleries, a rocking cutlery device provided in the frame having a plurality of second projection shaped cutleries disposed at locations offset relative to the first cutleries of the fixed cutlery device, and mounted for pivotally rocking around a fulcrum and facing the fixed cutlery device, said fulcrum of the rocking cutlery device being provided at a lower part of the frame, and a rocking means for rocking the rocking cutlery device;

wherein each of the first projection-shaped cutleries of the fixed cutlery device and the second projection-shaped cutleries of the rocking cutlery device are formed in a one of a truncated cone and a truncated semi-cone shape, said first projection-shaped cutleries and said second projection-shaped cutleries being constructed and arranged so that when said cutlery devices are engaged face-to-face with each other, a clearance is defined between adjacent first projection shaped cutleries and second projection-shaped cutleries.

While the novel features of the invention are set forth in a general fashion, both as to organization and content, it will be better understood and appreciated, along with other objections and features thereof, from the following detailed description taken in conjunction with the drawings.

BRIEF DESCRIPTION OF THE DRAWINGS

Further objects and features of the present invention will be understood more clearly from the following detailed description of the embodiments thereof, when read with reference of the drawings.

DETAILED DESCRIPTION OF THE INVENTION

An embodiment of the crushing-breaking apparatus in the present invention will be described hereunder.

As shown in FIG. 1, FIG. 2, FIG. 3 and FIG. 4, both of a fixed cutlery device 4 and a rocking cutlery device 9 are provided in a frame 1 slanted a little outwardly. The frame 1 having side plates **7*a* and 7*b* facing with each other and spaced by a distance has a couple of bearing boxes 2*a*, 2*b* and some spacers 3*a*, 3*b*** on both sides (see FIG. 2).

Figure 1:
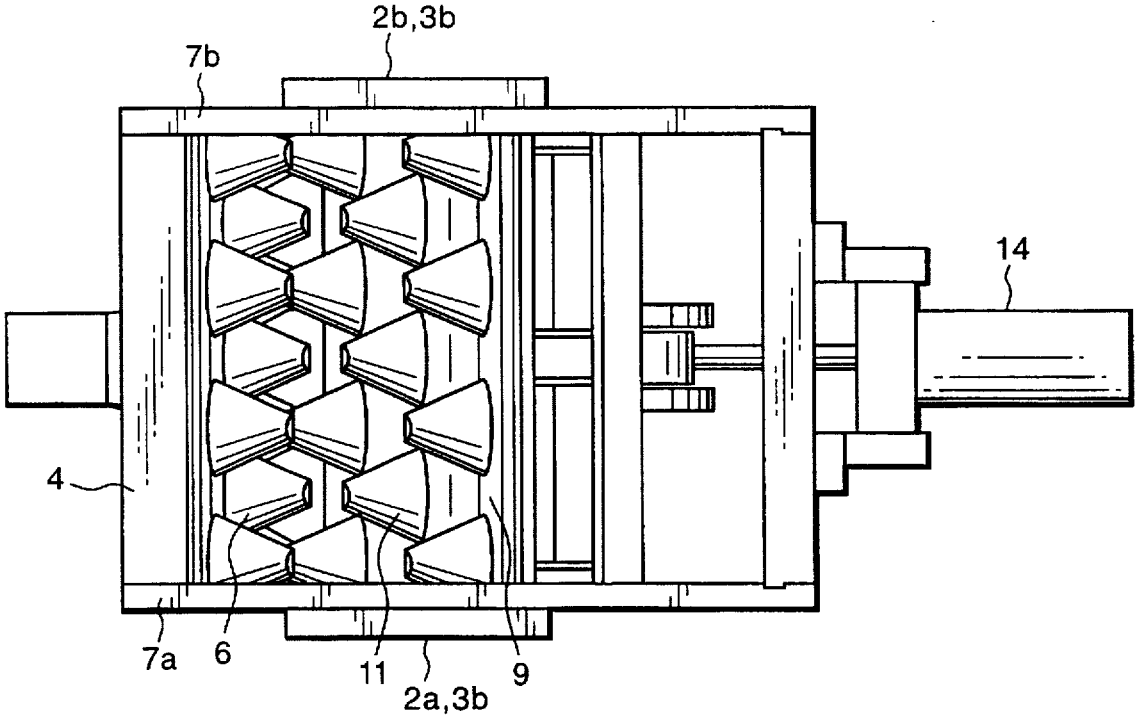
FIG. 1 is a plane view of the crushing-breaking apparatus in the present invention.
Figure 2:
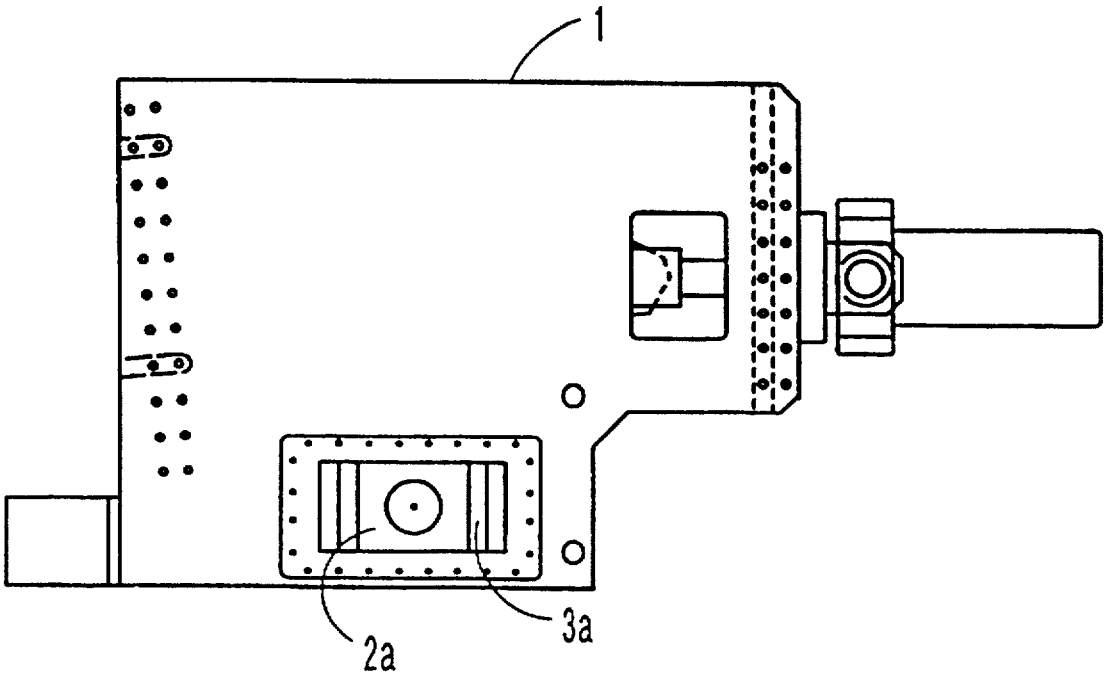
FIG. 2 is a side view of the crushing-breaking apparatus shown in FIG. 1.
Figure 3:
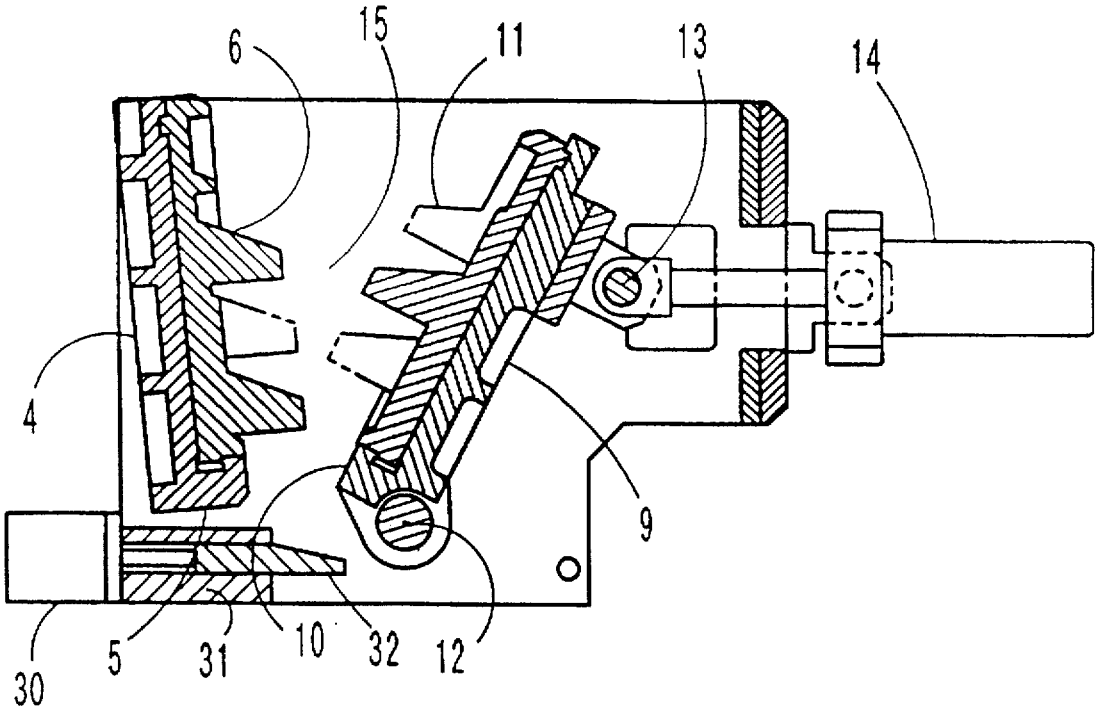
FIG. 3 is a cross-sectional view of the crushing-breaking apparatus in the present invention.
Figure 4:
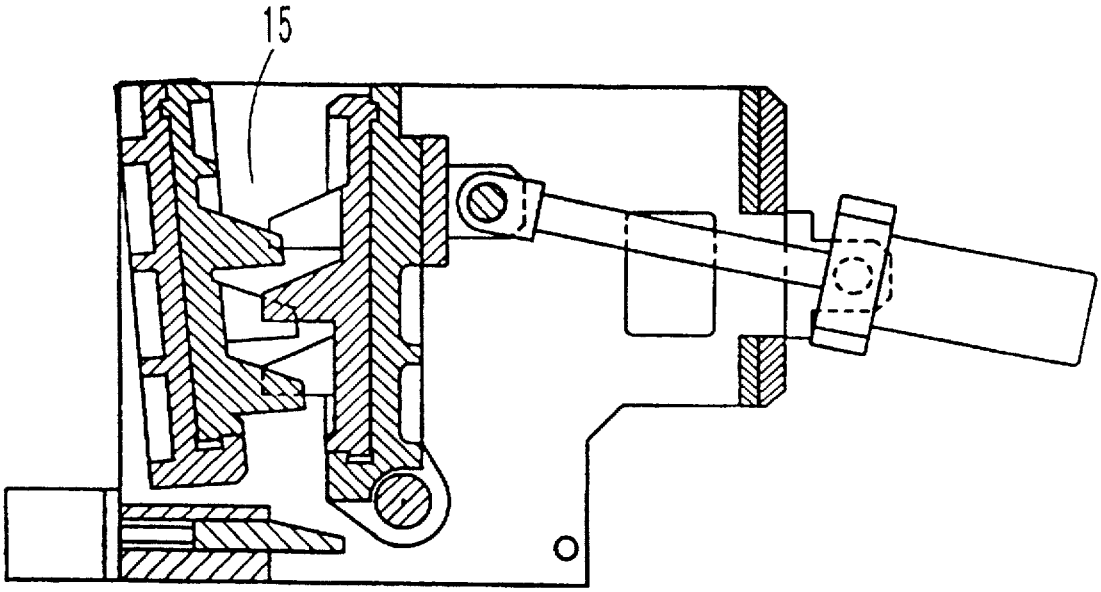
FIG. 4 is a cross-sectional view of the rocking cutlery device of the invention.
Figure 5:
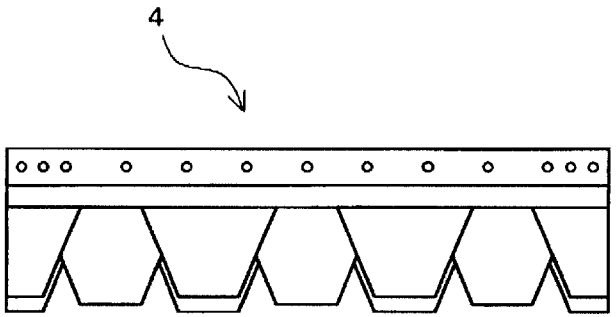
FIG. 5 is a plane view of the fixed cutlery device.

The fixed cutlery device 4 has a fixed cutlery holder 5 and a plurality of truncated semi-cone shaped cutleries 6 as first projection-shaped cutleries (see FIG.1, FIG. 3). FIG. 5 is a plane view of the fixed cutlery device 4.

Also, the rocking cutlery device 9 has a rocking cutlery holder 10 and a plurality of truncated semi-cone shaped cutleries 11 as second projection-shaped cutleries (see FIG.1, FIG. 3).

The truncated semi-cone shaped cutleries 11 are disposed at locations offset relative to the truncated semi-cone shaped cutleries 6 of the fixed cutlery device 4. Further, the rocking cutlery device 9 has a lower pivot (fulcrum) 12 and an upper pivot 13 (see FIG. 3). Both ends of the fulcrum 12 are supported to the bearing boxes **2*a*, 2*b* installed in the frame 1** (see FIG. 2).

Also, an oil pressure cylinder 14 as rocking means is fixed to the frame 1 tightly, and is connected to the upper pivot 13. So that, the rocking cutlery device 9 is rocked pivotally around the fulcrum 12 and facing the fixed cutlery device 4 by the oil pressure cylinder 14.

In the frame 1, a space 15 shaped like a wedge is formed between the fixed cutlery device 4 and the rocking cutlery device 9. The fulcrum 12 can be moved by sliding the bearing boxes 2a, 2b and rearranging some spacers 3a, 3b for adjusting appropriate position of pivot.

A stopper 32 shaped like a taper plate is slid parallel to a lower side of the frame 1 by an oil pressure cylinder 30 in the stopper housing 31 under the fixed cutlery device 4. Every cutlery is made of the alloy of Fcd650—Mn—Sb—Ni—Cu and built up welding by such processes;

1) building up welding using the alloy of Fe—Ni;

2) building up welding using the alloy of Ni—Cr—Mo;

3) building up welding using the alloy of Mn—Cr—special element.

Detailed operation of the crushing-breaking apparatus is described herein. When the piston of the oil pressure cylinder 14 is moved backwardly to the back-dead position, the rocking cutlery device 9 is rocked to the back-dead position by pivoting around the fulcrum 12, and the space 15 becomes the largest.

When the piston of the oil pressure cylinder 14 is moved forwardly to the front-dead position, the rocking cutlery device 9 is rocked to the front-dead position, and the truncated semi-cone shaped cutleries 11 of the rocking cutlery device 9 are facing and engaged with the truncated semi-cone shaped cutleries 6 of the fixed cutlery device 4 completely, and the space 15 becomes the smallest.

Figure 6:
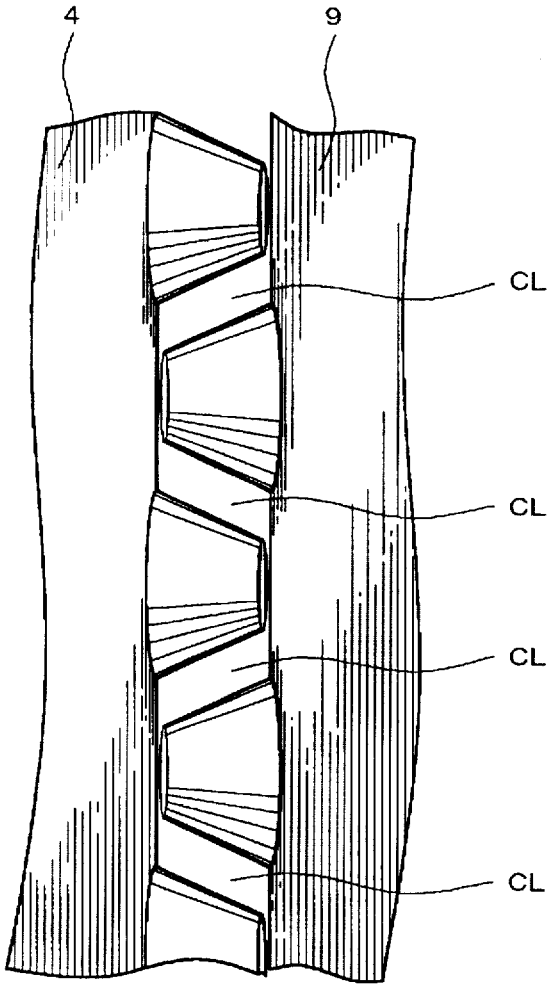
FIG. 6 is a plane view showing clearances formed between the fixed cutlery device and the rocking cutlery device.

FIG. 6 is a plane view showing clearances CL defined between adjacent truncated semi-cone shaped cutleries of the fixed cutlery device 4 and the rocking cutlery device 9. The clearances CL are formed even when the cutlery devices are engaged with each other completely.

When useless casting products are put into this crushing-breaking apparatus, they are pressed by both cutlery devices, and not pushed upward as stopped by the truncated semi-cone shaped cutleries, and crushed and broken by both cutlery devices 4, 9 at upper position of the space 15, and become small parts.

The useless casting products became small parts at the upper position of the space 15 and fall down to the lower part of the space 15 through the clearances CL. In other words, large size useless casting products will be crushed and broken at the upper part of the apparatus and will fall down to the lower part of the apparatus through the clearances CL which enables the apparatus to reliably cut large size useless casting products.

If some of the products falling down through the clearances CL are not broken, these products are held by the stopper 32 which has been pushed forward by an oil pressure cylinder 30.

Also the products held by the stopper 32 are crushed and broken more strongly by both cutlery devices 4, 9 at lower position of the space 15. So that, the products become still smaller parts, and fall down onto the bottom not disturbed by the stopper 32 which has been pushed backward.

That is, the crushing-breaking apparatus in the present invention can accommodate irrespective of the size and shape of the useless casting products to be crushed, broken. Therefore, it is possible for the crushing-breaking apparatus to cut large size and/or irregular shape useless casting products to a size suitable for recycling.

Due to every cutlery of the cutlery devices being disposed at locations offset relative to the cutleries of the other cutlery device and the rocking cutlery device being rocked pivotally around the fulcrum 12, any useless casting product can be crushed and broken in any posture.

The rigidity of the fixed cutlery device and the rocking cutlery device become as strong as they are not very transformed. Due to building up special welding of three layers on the surfaces of every cutlery, its wear becomes very little.

Figure 7:
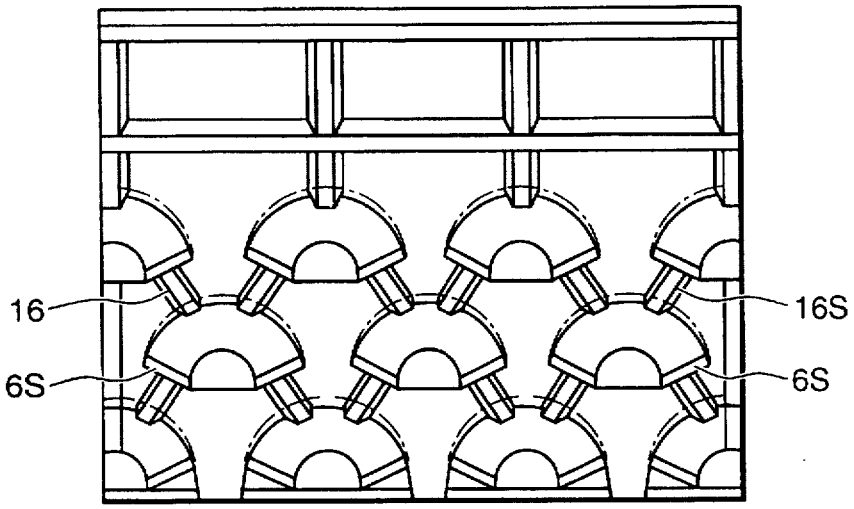
FIG. 7 is a front view of another embodiment of the fixed cutlery device.
Figure 8:
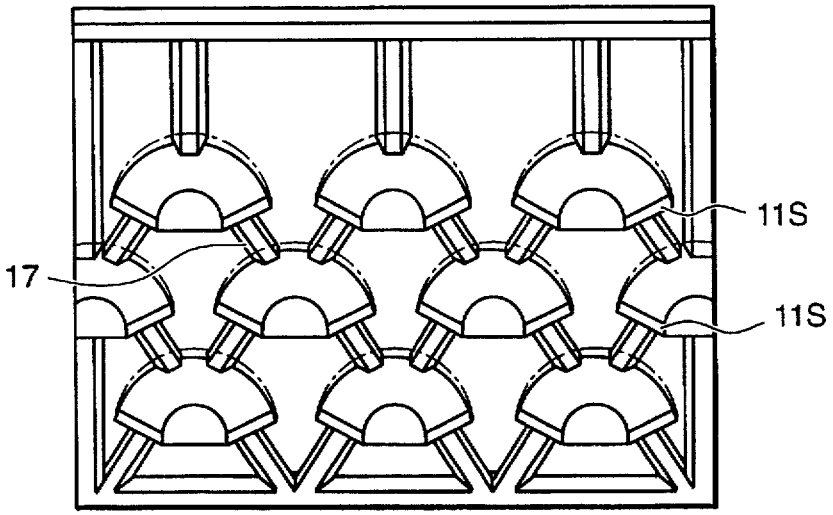
FIG. 8 is a front view of another embodiment of the rocking cutlery device.

FIG. 7 is a front view of another embodiment of the fixed cutlery device 4. And FIG. 8 is a front view of another embodiment of the rocking cutlery device 9. In this embodiment, ribs 16 and ribs 17 connecting the cutleries of the fixed cutlery device 4 and the rocking cutlery device 9 are provided thereon respectively.

Therefore, the rigidity of the fixed cutlery device 4 and the rocking cutlery device 9 is increased. In addition to the rigidity, the ribs 16 and the ribs 17 help to cut useless casting products when the cutlery devices are engaged with each other. Because, both of the ribs 16, 17 have cutting faces 16S, 17S respectively. So that, potential of the crushing-breaking apparatus is increased.

Further to above, each of the cutleries disposed on the fixed cutlery device 4 and the rocking cutlery device 9 has cutting faces 6S, 11S respectively. So that, crushing and breaking of useless casting products can be facilitated.

Figure 9:
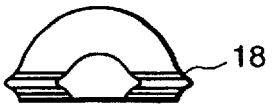
FIG. 9 is a front view of another embodiment of the cutleries

The cutleries can be formed as shown in FIG. 9 which has two line-projections 18 on both sides. Due to the cutlery having two line-projections on both sides, some of useless casting products are more easily crushed and broken.

Figure 10:
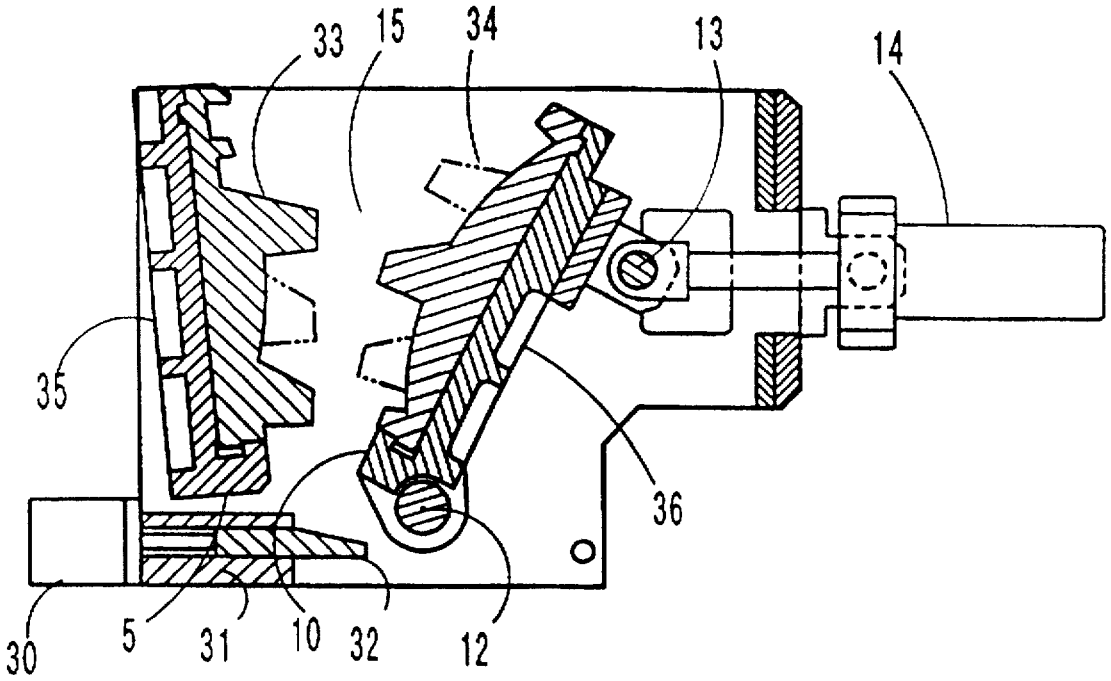
FIG. 10 is a cross-sectional view of far another embodiment of the crushing-breaking apparatus.
Figure 11:
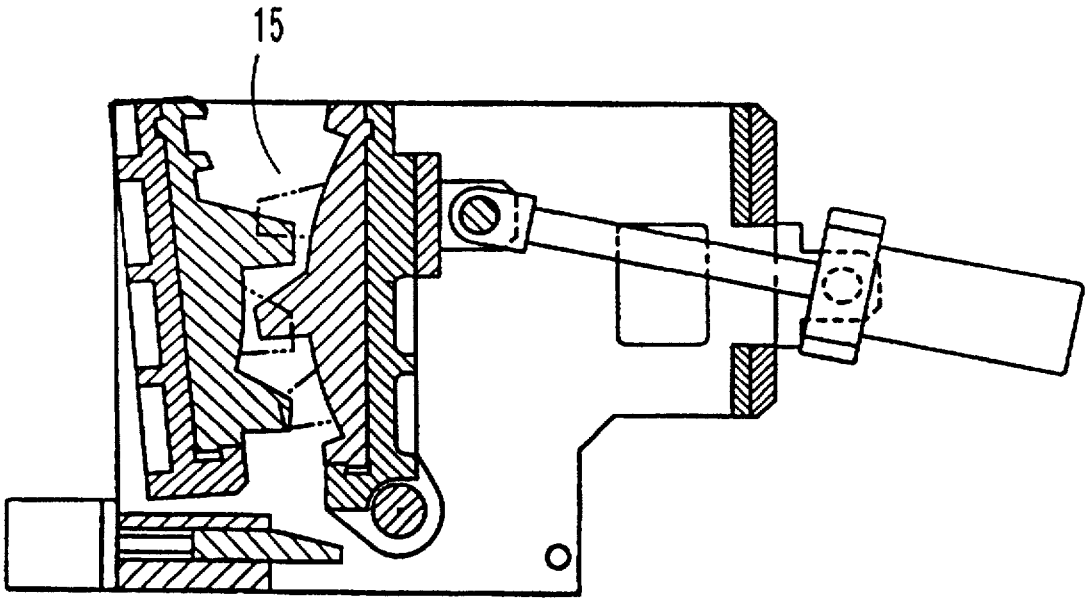
FIG. 11 is a cross-sectional view of far another embodiment of the crushing-breaking apparatus.

FIG. 10 and FIG. 11 show another embodiment of the crushing-breaking apparatus in the present invention. In this embodiment, a base of a fixed cutlerie 33 shaped like a semi-cylindrical plate replaces fixed cutleries 6 in FIG. 3, and a base of a rocking cutlerie 34 shaped like a semi-cylindrical plate replaces the rocking cutleries 11.

By utilizing the crushing-breaking apparatus shown in FIG. 10 and FIG. 11, it is possible to cut large size and/or irregular shape useless casting products to a size suitable for recycling.

Figure 12:
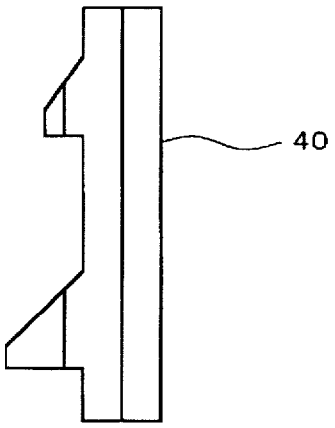
FIG. 12 is a side view of still another embodiment of the fixed cutlery device.

FIG. 12 is a side view of another embodiment of the fixed cutlery device 40. The fixed cutlery device 40 can be formed as shown in FIG. 12.

FIG. 13, 14, FIG. 15 and FIG. 16 show cross sectional views of still another embodiment of the crushing-breaking apparatus in the present invention. The rocking cutlery device 9 is also rocked pivotally around the fulcrum 12. In this embodiment, a damping plate 25 as the damper is provided to a lower part of the rocking cutlery device 9. The damping plate 25 is bent over a direction of the fulcrum 12.

Figure 13:
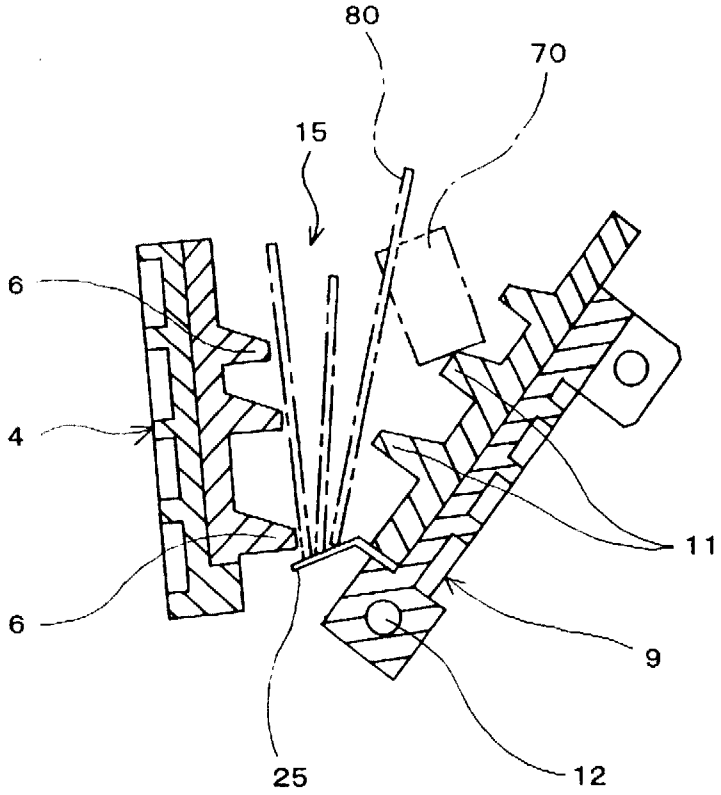
FIG. 13 is a cross-sectional of still another embodiment of the crushing-breaking apparatus.

When the piston of the oil pressure cylinder 14 (not shown) is moved backwardly to the back-dead position, an end (first end) of the damping plate 25 is located closely to the cutleries 6 of the fixed cutlery device 4 as shown in FIG. 13. So that, lanky casting products such as runners 80 existing in the space 15 are not discharged from the bottom of the frame.

Figure 14:
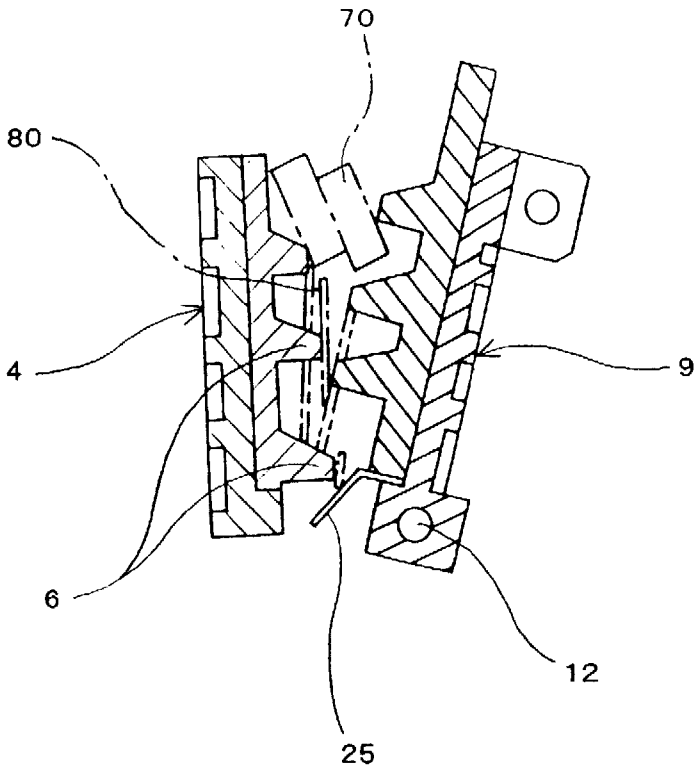
FIG. 14 is a cross-sectional of still another embodiment of the crushing-breaking apparatus.

FIG. 14 shows a condition of the runners 80 and weirs 70 when the piston of the oil pressure cylinder 14 is moved forwardly to the front-dead position. The runners 80 and the weirs 70 existing in the space 15 are crushed and broken between the cutleries 6 of the fixed cutlery device 4 and the cutleries 11 of the rocking cutlery device 9. During the crushing/breaking, the useless casting products crushed/broken are fall down to the lower part of the space 15 through the clearances CL.

Some of the products become suitable for recycling are discharged between a gap (second gap) formed between the end of the damping plate 25 and the cutleries 6. However, discharge of the products not crushed/broken to the suitable size is prevented by the damping plate 25 as shown in FIG.

Figure 15:
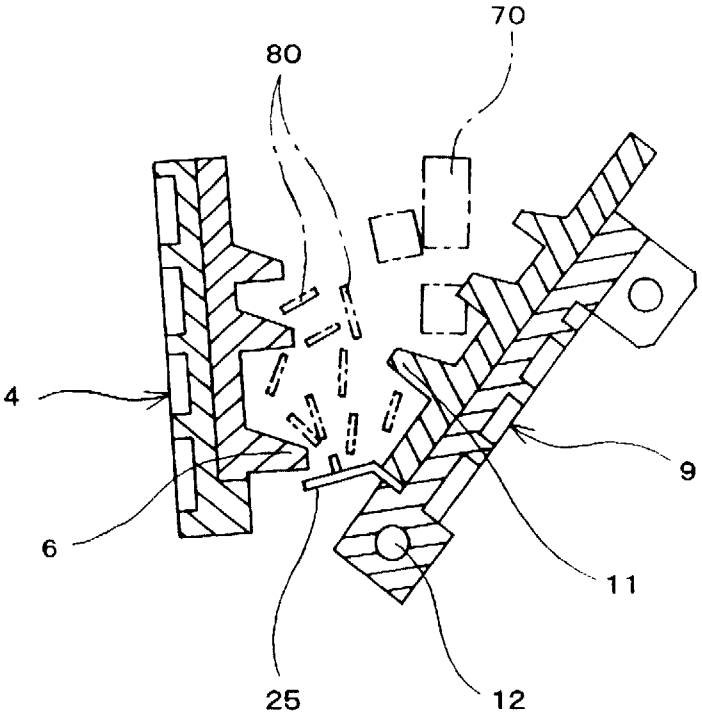
FIG. 15 is a cross-sectional of still another embodiment of the crushing-breaking apparatus.

14. FIG. 15 shows a condition of another back-dead position. Although, most of the runners 80 and weirs 70 are crushed/broken, only the runners 80 and weirs 70 become suitable for recycling are discharged between the gap.

Figure 16:
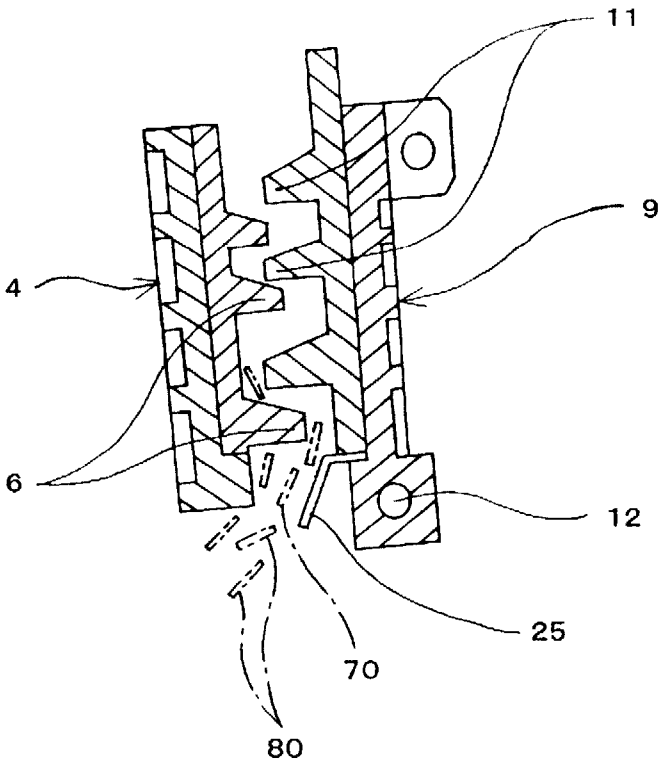
FIG. 16 is a cross-sectional of still another embodiment of the crushing-breaking apparatus.

FIG. 16 shows a condition of the front-dead position of the piston. When most of the runners 80 and the weirs 70 become suitable for recycling, the piston can be moved to the front-dead position. So that, the gap (first gap) formed between the end of the damping plate 25 and the cutleries 6 becomes the largest. Consequently, all the runners 80 and the weirs 70 become suitable for recycling are discharged from the bottom of the frame.

Therefore, it is possible for the crushing-breaking apparatus to cut large size and/or irregular shape useless casting products to a size suitable for recycling.

The fixed cutlery device shown in FIG. 7, the rocking cutlery device shown in 8, and the cutleries shown in FIG. 9 can be applied to the crushing-breaking apparatus shown in FIG. 10, FIG. 11, and the crushing-breaking apparatus shown in FIG. 13 to FIG. 16.

Obviously, numerous modifications and variations of the present invention are possible in light of the above teachings. It is therefore to be understood that within the scope of the appended claims, the invention may be practiced otherwise than as specifically described herein.

What is claimed is:

1. A crushing-breaking apparatus comprising:

a frame having side plates facing each other and spaced apart by predetermined distance, a fixed cutlery device provided in the frame, having a plurality of first projection-shaped cutleries, a rocking cutlery device provided in the frame having a plurality of second projection shaped cutleries disposed at locations offset relative to the first cutleries of the fixed cutlery device, and mounted for pivotally rocking around a fulcrum and facing the fixed cutlery device, said fulcrum of the rocking cutlery device being provided at a lower part of the frame, and a rocking means for rocking the rocking cutlery device;

wherein each of the first projection-shaped cutleries of the fixed cutlery device and the second projection-shaped cutleries of the rocking cutlery device are formed in a one of a truncated cone and a truncated semi-cone shape, said first projection-shaped cutleries and said second projection-shaped cutleries being constructed and arranged so that when said cutlery devices are engaged face-to-face with each other, a clearance is defined between adjacent first projection shaped cutleries and second projection-shaped cutleries.

2. A crushing-breaking apparatus in accordance with claim 1, wherein the projection-shaped cutleries located on each of the fixed cutlery device and the rocking cutlery device are formed in a truncated cone shape with cutting faces.

3. A crushing-breaking apparatus in accordance with claim 1, wherein the projection-shaped cutleries located on each of the fixed cutlery device and the rocking cutlery device are formed in a truncated cone shape having cutting faces with line-projections on a slope of the cone.

4. A crushing-breaking apparatus in accordance with claim 1, wherein a base of the fixed cutlery device and a base of the rocking cutlery device are each made of semi cylindrical plates.

5. A crushing-breaking apparatus in accordance with claim 1, wherein the fulcrum of rocking cutlery device is supported by a couple of bearing boxes in stalled in the frame, and the position of the bearing boxes can be moved.

6. A crushing-breaking apparatus in accordance with claim 1, wherein ribs extend between and connect adjacent cutleries of the respective cutlery devices.

7. A crushing-breaking apparatus in accordance with claim 1, further comprising:

a stopper parallel to a lower side of the frame.

8. A crushing-breaking apparatus in accordance with claim 1, wherein the rocking means comprises an oil pressure cylinder and peripheral equipment therefor.

9. A crushing-breaking apparatus in accordance with claim 1, wherein the fixed cutlery device and the rocking cutlery device are made of the alloy of Fcd650—Mn—Sb—Ni—Cu and built up welding by such processes;

1) building up welding using the alloy of Fe—Ni;

2) building up welding using the alloy of Ni—Cr—Mo;

3) building up welding using the alloy of Mn—Cr—special element.

10. A crushing-breaking apparatus in accordance with claim 1, further comprising:

a damper having a first end and a second end provided to a lower part of the rocking cutlery device, and forming a first gap sufficient enough for discharging broken-crushed objects between the first end of the damper and the cutleries disposed on the fixed cutlery device when the rocking cutlery device and the fixed cutlery device being engaged face-to-face with each other, and forming a second gap narrower in width than the first gap for preventing discharge of unbroken-uncrushed objects between the first end of the damper and the cutleries disposed on the fixed cutlery device when the rocking cutlery device and the fixed cutlery device are not engaged face-to-face with each other.

* * * * *